US007090434B1

(12) United States Patent
Thompson, Jr.

(10) Patent No.: US 7,090,434 B1
(45) Date of Patent: Aug. 15, 2006

(54) CAISSON REMOVAL PROCESS

(75) Inventor: Robert M. Thompson, Jr., Houma, LA (US)

(73) Assignee: Cross Rentals, Inc., Houma, LA (US)

( * ) Notice: Subject to any disclaimer, the term of this patent is extended or adjusted under 35 U.S.C. 154(b) by 0 days.

(21) Appl. No.: 11/120,893

(22) Filed: May 3, 2005

(51) Int. Cl.
*E02D 9/00* (2006.01)

(52) U.S. Cl. ..... 405/224.1; 405/226

(58) Field of Classification Search ..... 405/224.1, 405/226, 228
See application file for complete search history.

(56) References Cited

U.S. PATENT DOCUMENTS 3,817,040 A * 6/1974 Stevens ..... 405/228
4,432,671 A * 2/1984 Westra et al. ..... 405/226
4,558,744 A * 12/1985 Gibb ..... 405/226
4,575,282 A * 3/1986 Pardue et al. ..... 405/228
4,808,037 A * 2/1989 Wade et al. ..... 405/226
5,704,732 A * 1/1998 Horton, III ..... 405/228
6,719,496 B1 * 4/2004 Von Eberstein ..... 405/224
6,910,831 B1 * 6/2005 Raines ..... 405/224.1

FOREIGN PATENT DOCUMENTS

WO 88/03196 * 5/1988

* cited by examiner

*Primary Examiner*—Frederick L. Lagman
(74) *Attorney, Agent, or Firm*—Garvey, Smith, Nehrbass & North, L.L.C.; Gregory C. Smith

(57) ABSTRACT

A method of removing a pipe, such as a caisson, from a body of water, after the platform has been removed which includes the steps of a high pressure head having a lifting padeye is secured to the upper end of the caisson; the caisson is then flooded with water; pressure is applied to the water column, so that a sufficient hydraulic force against the surface of the water bottom within the caisson to force the caisson to move upward; if the caisson moves upward to the level of the top of a crane, the caisson is cut off above the water line and the cut portion is removed; the process is repeated on the remaining portion of the caisson in the water, until the entire caisson is finally removed from the water. This process could also be used in removal of pilings from multi-leg jackets.

11 Claims, 3 Drawing Sheets

CAISSON REMOVAL PROCESS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Technical Field of the Invention

The present invention relates to caisson pipe. More particularly, the present invention relates to the removal of caisson pipe of single-leg caisson decks and the removal of the pilings of multi-leg platform jackets by the use of high pressure water.

2. General Background of the Invention

In the drilling and production of oil and gas in deep water conditions, the drilling and production platforms are maintained above the waterline by being supported by a plurality of legs of caissons which have been driven into the bottom of the water. However, once these platforms have been abandoned, it is required that the platform and the supporting legs or caissons be removed.

At present, caisson piles are removed by removing the earth around the outside of the pipe to an acceptable depth below the mud line and then a cutter of some sort is used to cut the caisson. The caisson is then cut below the mud line and the caisson pie is left in the earth. Another method involves a high pressure water blaster or a mechanical cutter of some kind being inserted into the inside of the caisson and lowered to some depth below the mud line. The caisson is then cut. Once again, the remaining pipe is left in the earth below the mud line.

Applicant has reviewed U.S. Pat. No. 6,719,496, a copy of which is submitted herewith the Information Disclosure Statement. The patent addresses the use of ROV installed suction piles. In the patent, the pipes are installed using gravity and suction, and the pipes are removed using water pressure introduced by an ROV. Since the pipes which are being removed by the '496 patent are pipes which are completely submerged, the use of the water surrounding the pipe completes the removal process. There is a need in the industry for a method to remove caisson pipe from a body of water, where the upper end of the pipe is protruding above the surface of the water.

Applicant is submitting herewith an information disclosure statement which includes additional prior art that applicant is aware of at this time.

BRIEF SUMMARY OF THE INVENTION

The present invention solved the problems in the art in a simple and straight forward manner. What is provided is a method of removing a pipe, such as a caisson, from a body of water, after the platform has been removed which includes the steps of a high pressure head having a lifting padeye is secured to the upper end of the caisson; the caisson is then flooded with water; pressure is applied to the water column, so that a sufficient hydraulic force against the surface of the water bottom within the caisson to force the caisson to move upward; if the caisson moves upward to the level of the top of a crane, the caisson is cut off above the water line and the cut portion is removed; the process is repeated on the remaining portion of the caisson in the water, until the entire caisson is finally removed from the water. This process could also be used in removal of pilings from multi-leg jackets.

Therefore, it is the principal object of the present invention to provide a method to remove an entire caisson from a body of water through use of high pressure water;

It is a further object of the present invention to provide a method of removing caissons from a body of water when the end of the caisson extends above the water line;

It is a further object of the present invention to provide a caisson removal process which allows the removal of a caisson of a length greater than the height of a removal crane so that the entire caisson is removed and not left in place.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENTS

Figure 1:
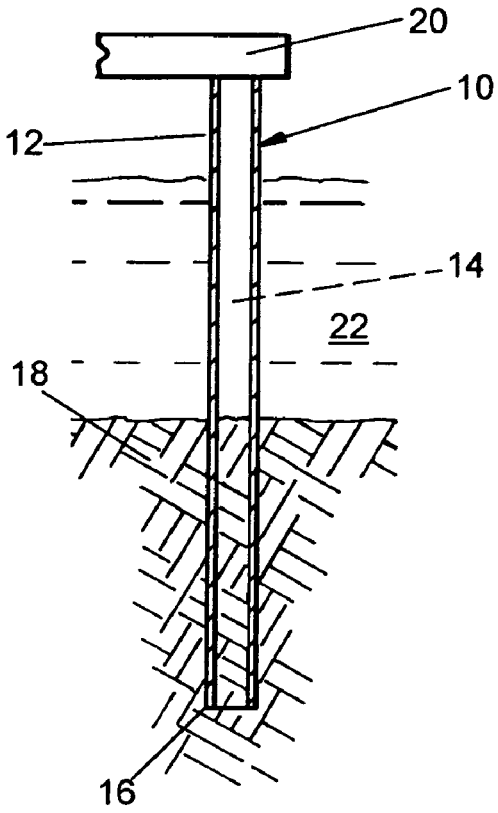
FIG. 1 illustrates a partial view of a caisson supporting a platform.

FIGS. 1 through 10 illustrate the steps involved in the method of removing caisson pipe from a body of water, such as the Gulf of Mexico. Turning first to FIG. 1, there is illustrated a typical caisson pipe 10, having a diameter of between 12 and 24 inches, with a continuous wall 12, defining a central space 14 throughout the caisson pipe 10. The lower end 16 of the pipe 10 has been driven into the water bottom 18 to a predetermined depth, so that the caisson pipe 10 can help support a platform 20, partially illustrated in FIG. 1, above the surface of a body of water 22.

Figure 2:
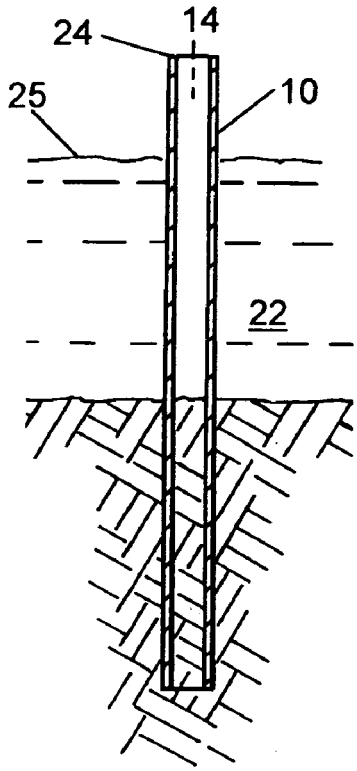
FIG. 2 illustrates a partial view of a caisson standing in water after the platform has been removed.
Figure 3:
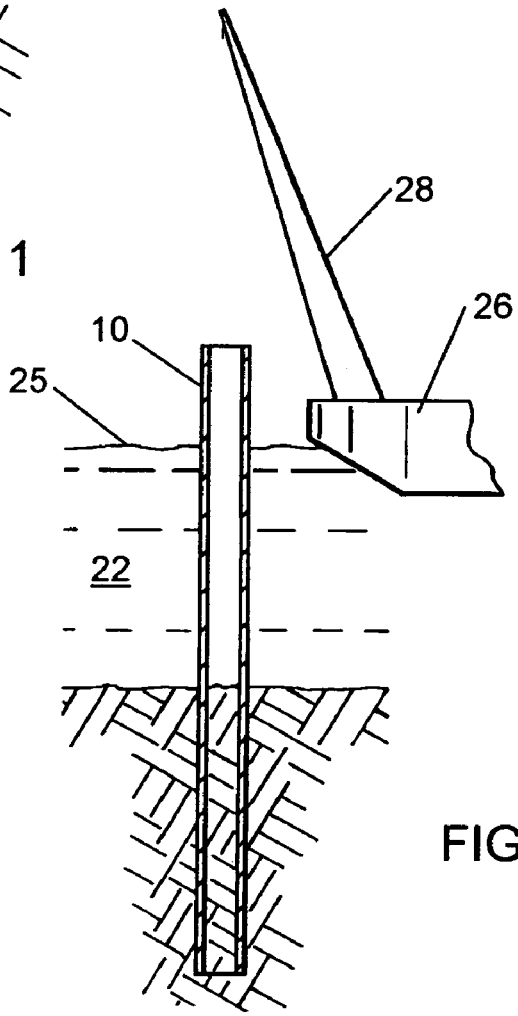
FIG. 3 illustrates a crane barge set above the caisson for removal.

Turning to FIG. 2, the platform 20 has been removed from the upper end 24 of the caisson pipe 10 in a conventional manner, and that process plays no part in this invention. In FIG. 2, the caisson pipe is open ended on its upper end 24 exposes the central space 14 above the surface 25 of the water. In FIG. 3, the caisson pipe 10 is in the same position, but a conventional crane barge 26 having a crane 28 on its deck, has been moved adjacent the upper end of the pipe 10.

Figure 4:
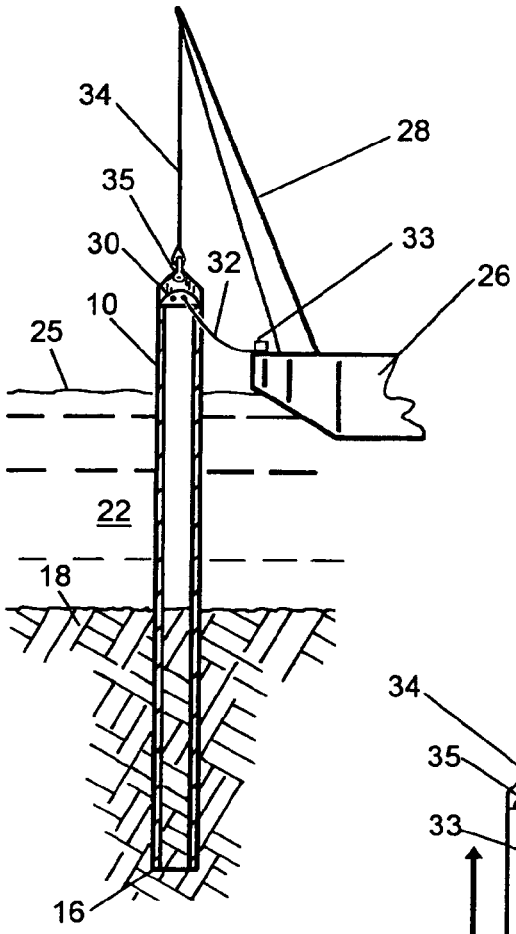
FIGS. 4 through 6 illustrate the initial steps in the removal of a portion of the caisson under high water pressure.

In FIG. 4, there is illustrated a high pressure head 30 has been secured to the upper end 24 of the caisson 10, preferably through welding or the like, so as to provide a fluid tight seal between the pipe 10 and the head 30. The high pressure head 30 is of the type that would accommodate a high pressure water supply line 32, extending from a high pressure pump 33 located on the barge 26, for pumping water under pressure into the central space 14 within the caisson pipe 10. The head 30 would also allow air to bleed from the space 14 through a bleed valve or the like as water filled the space 14. As illustrated, the head 30 would include a padeye 35 which would allow a line 34 extending from the crane 28 to pull the caisson pipe 10 away from the site as will be explained further.

Figure 5:
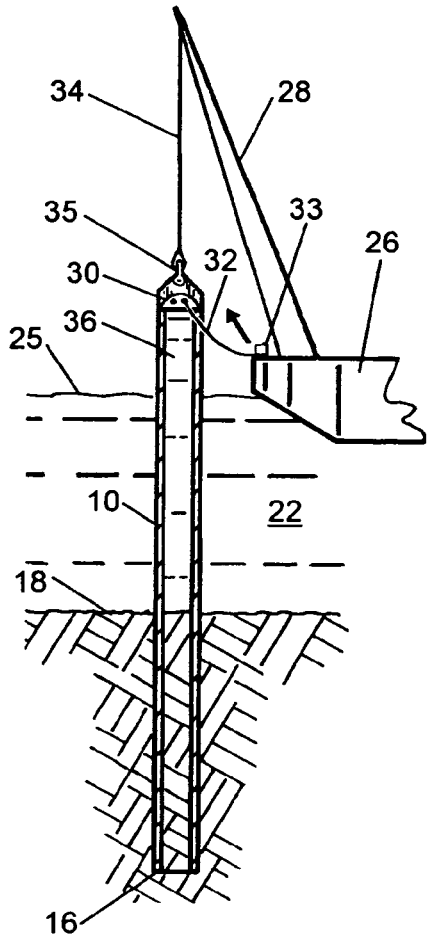

In FIG. 5, there is illustrated the same view as FIG. 4, except that in this step in the process water 36 has been pumped into the space 14 in the pipe 10, from a conventional high-pressure water pump which would be located on the barge 26.

Figure 6:
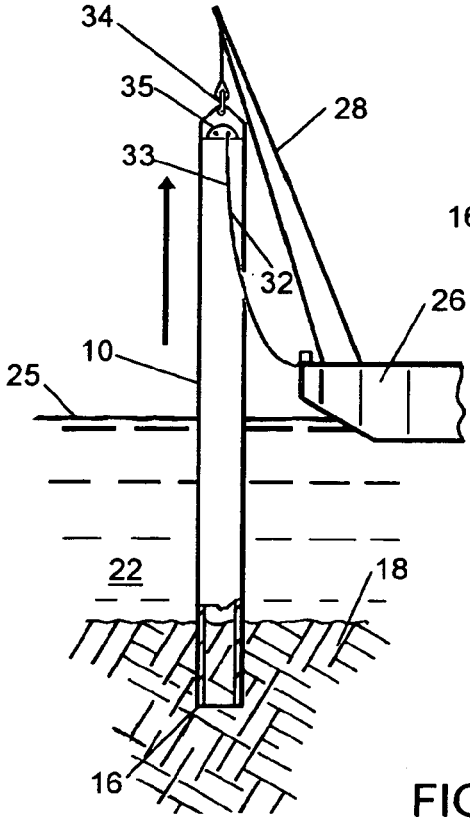
Figure 7:
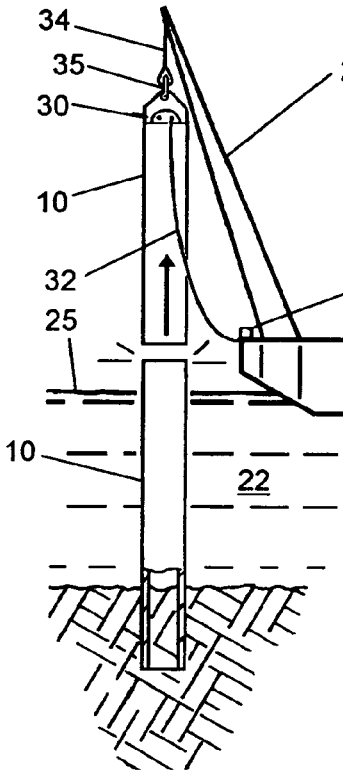
FIGS. 7 through 10 illustrate the remaining steps involved in the removal of the entire caisson from the water.
Figure 8:
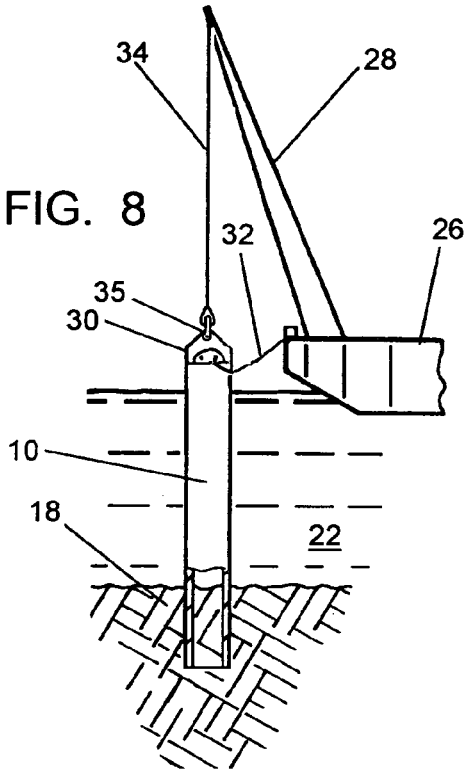

In FIG. 6, there is illustrated the dynamics that is taking place between the view in FIGS. 5 and 6. As water is pumped into the space 14, the column of water 36 would fill space 14, and exert hydraulic pressure on the water bottom 18 and the head 30, to the extent that the water would literally begin to force the caisson 10 upward in order to accommodate more water under pressure within the space 14. While the caisson pipe 10 has moved upward in FIG. 6, because it may be longer than the height of the crane 28, FIG. 7 illustrates that the water would be shut down, and the caisson pipe 10 would be cut off just above the water line 25 and the cut off portion of the pipe 10 would be moved away from the site by the crane 28. This process would be repeated as long as the caisson pipe 10 being removed would begin to reach the height of the crane 28.

Figure 9:
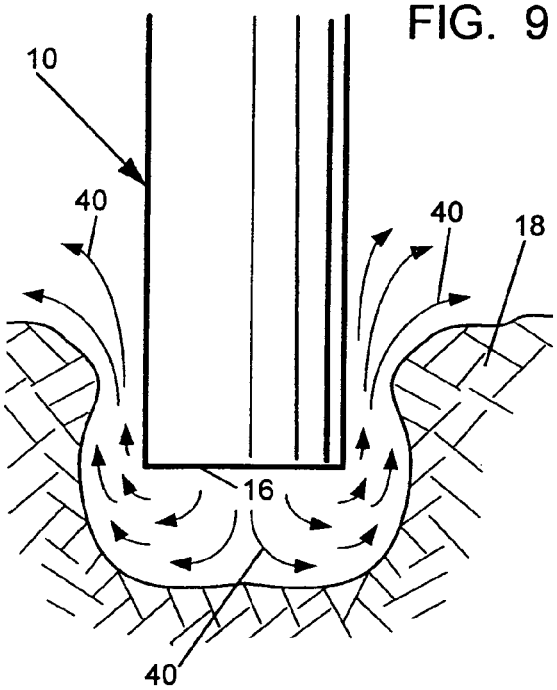
Figure 10:
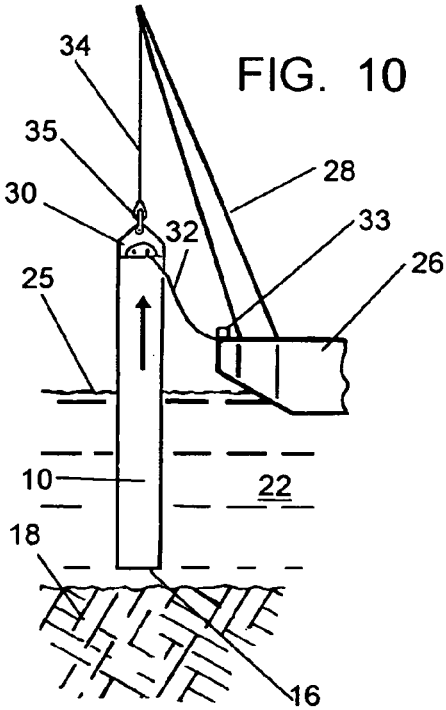

Once this is accomplished, the head 30 would then be removed from the portion of the pipe 10 which has been placed on the barge 26, and the head 30 would then be welded to the portion of the caisson pipe 10 remaining in the water. The process as described above would be repeated with the water under pressure until the caisson pipe 10 nears removal. FIG. 9 illustrates the lower end 13 of the caisson pipe 10 which has been forced upward near the vicinity of the water bottom 18. At some point before the lower end 13 of the pipe 10 is removed from the mud, the high pressure water will forced the mud around the end to flow away due to the high pressure, as seen by arrows 40. When this is recorded from the water flow from the pump, the final step of the process would simply be to shut down the pump and lift the pipe 10 from the water, as is illustrated in FIG. 10.

In this process the caisson pipe 10 is being completely removed, albeit in sections, and none of the pipe remains in the soil beneath the water, which is environmentally important. Also, during the process, the water pressure and rate of flow is monitored closely to control the movement of the caisson pipe 10 as it is forced out of the soil by the hydraulic force of the water.

The following is a list of parts and materials suitable for use in the present invention:

PARTS LIST:

| Parts Number | Description |
|---|---|
| 10 | caisson pipe |
| 12 | wall |
| 14 | central space |
| 16 | lower end |
| 18 | water bottom |
| 20 | platform |
| 22 | water |
| 24 | upper end |
| 25 | water surface |
| 26 | crane barge |
| 28 | crane |
| 30 | high pressure head |

-continued

PARTS LIST:

| Parts Number | Description |
|---|---|
| 32 | water supply line |
| 33 | high pressure pump |
| 35 | padeye |
| 36 | water |
| 38 | water bottom |
| 40 | arrows |

The foregoing embodiments are presented by way of example only; the scope of the present invention is to be limited only by the following claims.

What is claimed is:

1. A method of removing an open-end caisson pipe or a piling from a multi-leg rig jacket extending above a water line, comprising the steps of:

a. welding a high-pressure head to an upper end of the pipe to provide a fluid-tight seal;

b. providing an opening in the head to pump water into the pipe;

c. pumping water through the head into the pipe under sufficient pressure to establish a hydraulic force within the pipe to dislodge the pipe from the water bottom and urge it upward out of the water bottom;

d. when the pipe extends a distance out of the water to a certain point, cutting the pipe off above the surface of the water and the head removed from the pipe; and e. welding the head to the upper end of the pipe in the water so that step c can be repeated until the remainder of the caisson is completely removed from the water.

2. The method in claim 1, further comprising the step of monitoring the upward movement of the pipe during step c of claim 1.

3. The method in claim 1, further providing a crane barge adjacent the pipe, with a line extending from the crane to a lifting padeye on the head.

4. The method in claim 1, when the pipe extends a distance from the water which would approach the height of the crane, the pipe would be cut off above the surface of the water and removed.

5. The process in claim 1, wherein the process may be utilized to remove caisson pipe, rig leg jackets and any other pipe extending above the surface of the water.

6. A method of removing open-ended caisson pipe from water, comprising the following steps:

a. securing a fluid-type, high-pressure head on an upper end of the pipe;

b. pumping water under pressure into the caisson pipe so that the water exerts sufficient hydraulic force on the head to cause upward movement of the pipe;

c. monitoring the upward movement of the pipe;

d. if the height of the pipe as it moves upward reaches the height of a removal crane, cutting the pipe off at the water line;

e. removing the cut portion of the pipe;

f. repeating steps a through d until the entire caisson pipe has been removed from the water.

7. The method in claim 6, further comprising the step of removing the head from the cut portion of the pipe and securing it onto the portion of the pipe remaining in the water to repeat steps a through d.

8. The method in claim 6, wherein the head is secured to the caisson pipe through welding.

9. The method in claim 6, wherein the water pumped into the caisson is pumped by a pump on a crane barge.

10. The method in claim 6, wherein the removal crane is secured to a crane barge docked adjacent the caisson pipe.

11. A method of removing open-ended caisson pipe from water, comprising the following steps:

a. securing a fluid-type, high-pressure head on an upper end of the pipe; the head including a lifting padeye;

b. pumping water under pressure through an opening in the head into the caisson pipe so that the water exerts a hydraulic force within the caisson pipe sufficient to cause upward movement of the pipe;

c. monitoring the upward movement of the pipe;

d. positioning a crane barge near the caisson pipe, so that if the height of the pipe as it moves upward is higher than a removal crane, cutting the pipe off at the water line;

e. removing the cut portion of the pipe by the crane via a crane line secured to the lifting padeye;

f. repeating steps a through e until the entire caisson pipe has been removed from the water.

* * * * *